US005423269A

United States Patent [19]

Saxton et al.

[11] Patent Number: 5,423,269

[45] Date of Patent: Jun. 13, 1995

[54] RAILROAD WELL CAR BODY INCLUDING SIDE SILL REINFORCING WALKWAY STRUCTURE

[75] Inventors: Gregory J. Saxton; James A. Hilsenteger, both of Portland, Oreg.

[73] Assignee: Gunderson, Inc., Portland, Oreg.

[21] Appl. No.: 158,260

[22] Filed: Nov. 23, 1993

Related U.S. Application Data

[63] Continuation-in-part of Ser. No. 982,289, Nov. 24, 1992, Pat. No. 5,279,230.

[51] Int. Cl.[6] ..... B61D 3/00

[52] U.S. Cl. ..... 105/355; 105/404; 105/436; 105/457; 410/54

[58] Field of Search ..... 105/457, 436, 355, 375, 105/404, 422, 406.1; 410/56, 54, 68

[56] References Cited

U.S. PATENT DOCUMENTS

| | | | |
|---|---|---|---|
| 1,085,196 | 1/1914 | Downing | 105/457 |
| 1,696,332 | 12/1928 | Sheehan . | |
| 1,699,529 | 1/1929 | Gibbs et al. . | |
| 1,875,584 | 9/1932 | Frede et al. . | |
| 1,889,605 | 11/1932 | Jones . | |
| 2,052,213 | 8/1936 | Branstrator | 105/422 |
| 2,278,554 | 4/1942 | Morton | 105/457 |
| 2,279,756 | 4/1942 | Lieberman | 105/457 |
| 2,401,401 | 8/1946 | Bartsch | 105/457 |
| 3,152,669 | 10/1964 | Johnston | 105/422 |
| 3,181,440 | 5/1965 | Mullaney et al. | 105/457 |
| 3,357,371 | 12/1967 | Gutridge | 410/54 |
| 3,420,192 | 1/1969 | Ellis | 105/422 |
| 3,731,967 | 5/1973 | Hughes | 105/457 |
| 4,091,742 | 5/1978 | Cordani | 105/366 |
| 4,288,957 | 9/1981 | Meehan | 105/422 |
| 4,456,413 | 6/1984 | Pavlick | 410/56 |
| 4,686,907 | 8/1987 | Woollam et al. | 410/56 |
| 4,703,699 | 11/1987 | Hill | 105/355 |
| 4,718,353 | 1/1988 | Schuller et al. | 105/406.1 |
| 4,771,706 | 9/1988 | Lindauer et al. | 105/415 |
| 4,782,762 | 11/1988 | Johnstone et al. | 137/355 |
| 4,862,810 | 9/1989 | Jamrozy et al. | 105/355 |
| 4,876,968 | 10/1989 | Lindauer et al. | 105/415 |
| 4,889,055 | 12/1989 | Jamrozy et al. | 105/355 |
| 4,949,646 | 8/1990 | Jamrozy et al. | 105/406 |
| 5,279,230 | 1/1994 | Thomas et al. | 105/355 |

FOREIGN PATENT DOCUMENTS

| | | | |
|---|---|---|---|
| 0510372 | 10/1992 | European Pat. Off. | 105/355 |
| 0510467 | 10/1992 | European Pat. Off. | 105/355 |

*Primary Examiner*—Mark T. Le

*Attorney, Agent, or Firm*—Chernoff, Vilhauer, McClung & Stenzel

[57] ABSTRACT

A railroad freight car including a cargo well for carrying optionally either intermodal cargo containers or highway semitrailers has a side sill structure including a deep rectangular top chord and a depending web, supporting a well floor structure. The well floor structure includes reinforcing longitudinal and transverse channel members and horizontal top and bottom plates attached to the channels. Large circular openings, aligned with one another, are defined in both the top and bottom plates, and a peripheral ring of vertical material interconnects the margins of the top and bottom plates around the openings, providing a light but stiff floor structure with a small vertical height. A side sill reinforcing walkway structure is located atop each side sill at each end of the cargo well, but is low enough to avoid interference with handling trailers.

4 Claims, 13 Drawing Sheets

RAILROAD WELL CAR BODY INCLUDING SIDE SILL REINFORCING WALKWAY STRUCTURE

This is a continuation-in-part of U.S. Pat. application Ser. No. 07/982,289, filed Nov. 24, 1992, now U.S. Pat. No. 5,279,230.

BACKGROUND OF THE INVENTION

The present inventions relates to railroad freight cars, and particularly to a well car of light-weight construction, for optionally carrying either intermodal cargo containers stacked one upon another or over-the-highway trailers supported on their own running gear in the well.

Railroad cars for carrying over-the-highway trailers are well known, as are railroad freight cars defining container wells for carrying various combinations of intermodal cargo containers stacked one upon another in two tiers. Because the total weight which can be carried upon the rails limits the net amount of cargo which can be carried on a railroad freight car, it is desirable for a well car to be constructed in a configuration having a minimum tare weight consistent with the strength required to safely support a combination of cargo containers for which the car is configured. It is also necessary, however, to provide an adequate surface to support the tires of trailers carried in the cargo well. Additionally, it is necessary for a car to be strong enough to withstand the many forces resulting from movement of the laden car as part of a train.

It is desired, then, to provide a well car capable of carrying the concentrated stresses resulting from carriage of intermodal cargo containers, while still having a minimum tare weight.

It is also desirable to provide a well floor structure whose vertical height, or overall thickness, is kept small, in order to minimize overall height of the well car when it is laden with containers stacked atop one another.

It is also necessary to provide a shallow well depth from floor top surface to the top of side sill giving trailer loading equipment access to the bottom of a trailer floor above the side sills so that trailers can be inserted into and extracted from the well. The reduction of bending resistance resulting from shallower side sills must be restored by other structure.

Well cars utilize inter box connectors (IBCs) to interconnect upper and lower containers when they are carried stacked one atop another in a well car. IBCs are usually located at a standard position between such stacked containers, corresponding to the location of an end of a standard intermodal container 40 feet long, for example, even though it is possible that a container more than 40 feet long may be carried.

It is necessary for a person to reach the IBC to operate it to interconnect or disconnect containers when a container is being loaded or removed from atop a lower tier container carried in a well of such a car. Since some containers are over 9' high, it may be difficult to reach the IBCs when standing atop a side sill of a container car, particularly one which has relatively low side sills. There is additional risk of falling where a well car is intended to carry containers having lengths greater than 40 feet. Some cars for carrying stacked containers therefore include walkways on which a person can stand to reach IBCs.

Some railroad freight cars are designed to carry trailers, or chassis and attached intermodal cargo containers, in a cargo well also equipped to carry stacked containers. The structure of such well cars must satisfy certain requirements. First, any walkway intended to provide access to IBCs interconnecting stacked containers carried in such a car should be located where they will not interfere with the proper operation of cranes used to move trailers into or out of such cars. Nevertheless, there is a significant likelihood that a loaded trailer or a trailer-loading crane will contact the uppermost part of a side sill or a walkway associated with the top of a side sill of such a well car, because of the need to move a trailer within the cargo well to engage the trailer hitch which is used to secure the trailer to the car.

Second, it is necessary for the car structure to carry loads, imposed upon the car by the weight of containers or trailers, from the side sills to the wheeled trucks supporting the car. However, such loads are concentrated in the side sill structure of the car near the ends, because of the need for clearance for the wheeled trucks to pivot.

Finally, a walkway for providing access to IBCs needs to have a non-skid upper surface, so that a worker can safely stand on the walkway despite wet, snowy, or icy conditions.

Previous attempts to provide the dual capacity for carrying containers or trailers have included cars incorporating transverse beams supporting substantial gratings on which to receive the tires of a trailer carried in the well, as disclosed in Pavlick U.S. Pat. No. 4,456,413. While such cars provide ample strength for carrying both containers and trailers, the structure is undesirably heavy, and the well floor thickness is greater than desired, leaving less than the desired amount of vertical space available for stacked cargo containers. The car disclosed in Gutridge U.S. Pat. No. 3,357,371 has a similar lack of vertical clearance.

Jamrozy U.S. Pat. No. 4,949,646, and Lindauer et al. U.S. Pat. Nos. 4,876,968 and 4,771,706 all disclose a well car for carrying containers, in which a well floor structure includes transverse floor beams. Johnstone et al. U.S. Pat. No. 4,782,762 discloses a well car including a floor with longitudinal and transverse beams, for carrying containers. Cordani U.S. Pat. No. 4,091,742 discloses a well car including a floor structure of transverse and diagonal beams for supporting containers, but none of these patents discloses structure for supporting the wheels of a trailer carried in such a well.

Jamrozy et al. U.S. Pat. Nos. 4,889,055 and 4,862,810 disclose a well car including longitudinal channels, transverse channels, and a longitudinal center plate in a well floor structure, but there is no disclosure of structure available to support the wheels of a trailer in the container well.

Hill U.S. Pat. No. 4,703,699 discloses a lightweight side sill structure for a well car for carrying stacked containers, in which an opening is provided in one of a pair of parallel sheets of material, and a stiffener ring surrounding the opening connects the margins of the opening with the other of the two parallel sheets of material.

Other cars, such as those operated by Canadian National Railroad as its CN679500 "Improved Laser" series cars include heavy gratings supported on the flanges of hat-shaped transverse beams, providing structure of ample strength but greater than desired well floor thickness and weight.

Schuller U.S. Pat. No. 4,718,353 discloses a well car including walkways fixed atop side walls defining a well for receiving a container. The walkways disclosed by Schuller, however, are attached to the car at widely spaced-apart locations, and area subject to being easily damaged or dislodged from the side walls of the car as a result of minor errors during handling of containers.

What is needed, then, is an improved structure for a railroad well car body for optionally carrying either stacked containers or trailers, in which a well floor structure and the connection of such a well floor to other parts of the car provide adequate strength without unnecessary weight and with shallow well depth and small floor thickness, and in which provision is made for a person to safely reach and operate inter-box connectors when containers are stacked in the cargo well.

SUMMARY OF THE INVENTION

The present invention provides an answer to the needs enumerated above and overcomes the aforementioned shortcomings of the prior art by providing a railroad freight car body having a cargo well defined in part by a pair of longitudinal side sills reinforced in the area of interconnection of the side sills to transverse body bolsters at each end of the car body. Preferably, a longitudinally-extending side sill reinforcing structure is mounted atop a top chord of the side sill and extends along a portion of the top chord, alongside a portion of the cargo well adjacent one of the opposite ends of the car body and a horizontal top of the reinforcing structure includes a raised walkway for supporting a person safely in the vicinity of inter-box connectors used with containers stacked in the cargo well of such a car.

In one embodiment of the invention the side sills are shallow and of lightweight construction and support a well floor of unified, lightened and stiffened structure attached to the side sills to form a light, yet strong and stiff, car body structure. Such a car is capable of withstanding the concentrated loads imposed by cargo containers and has the necessary floor area of sufficient strength to support the wheels of trailers at any longitudinal location, and still is sufficiently light in overall weight to permit carriage of stacked intermodal cargo containers without undue limitation of their net cargo weight.

In one embodiment of the invention the side sills include a deep rectangular top chord and a web of relatively thin material extending diagonally down to a well floor assembly. The well floor assembly is attached to the web continuously along its length, so that the well floor acts as a lower chord for the side sill, but is suspended beneath the top chord of the side sill along the entire length of the well floor.

In such an embodiment of the invention, because the thin web extending diagonally down is located to carry primarily tension loads, it is not subject to buckling and no side posts are required in the side sill as in less efficient car construction. The avoidance of side posts reduces weight, cost and the presence of welds transverse to the principal stress direction.

Lateral loads from the cargo are substantially carried by the stiff floor structure and are substantially transferred to the ends of the car, not carried via the side sill webs or side posts as in previous well cars.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
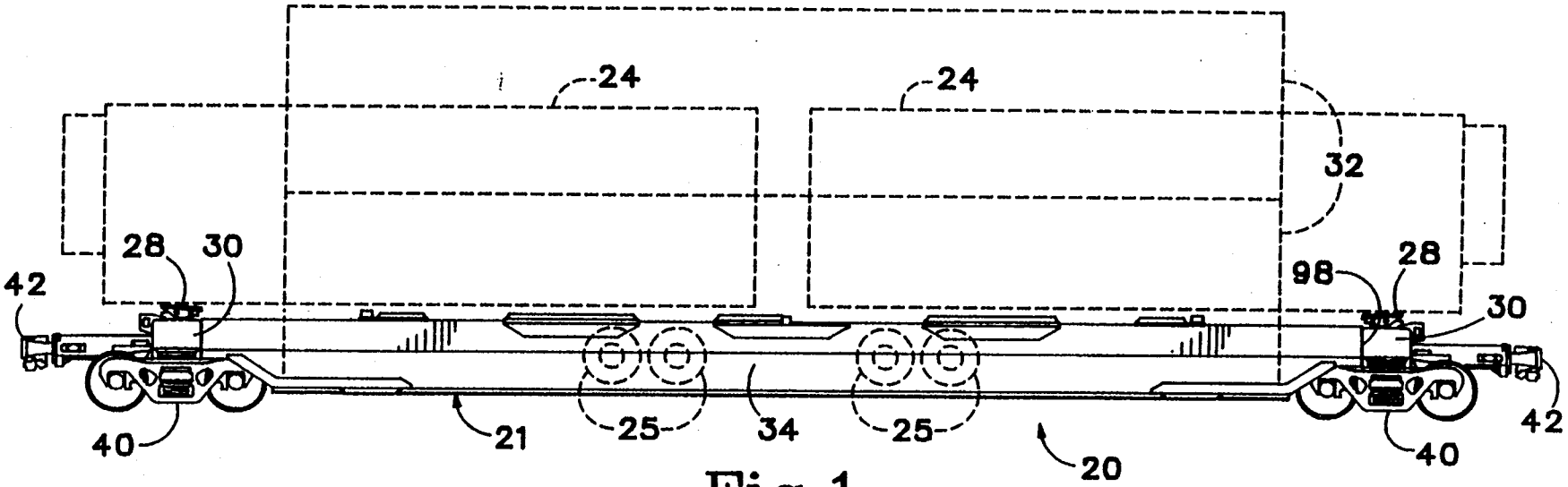
FIG. 1 is a side elevational view of a railroad freight car embodying the present invention and laden with a pair of semi-trailers carried in a cargo well defined in the car body.
Figure 2:
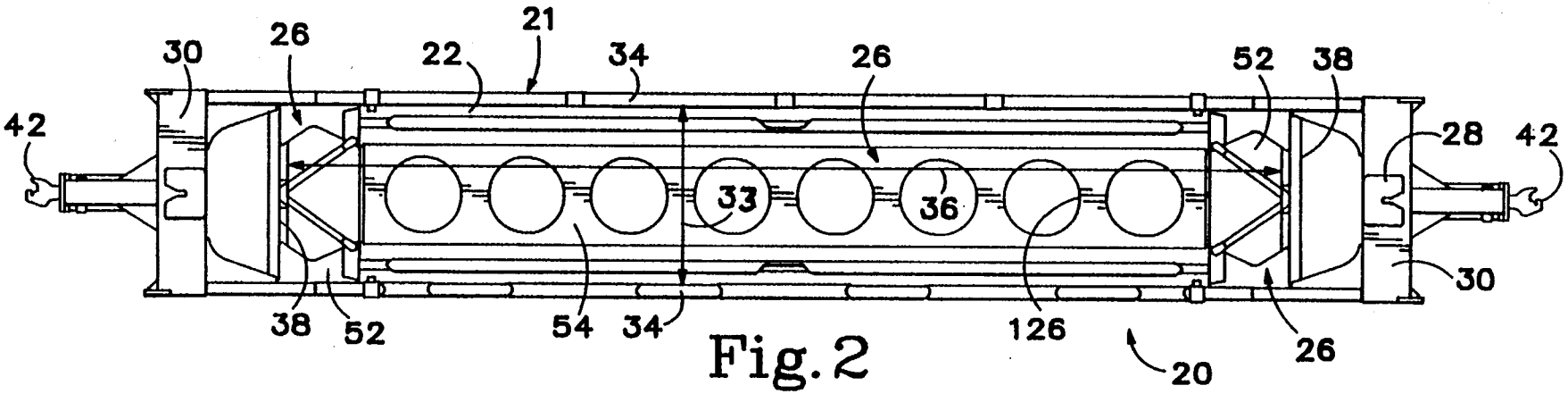
FIG. 2 is a top plan view of the railroad car shown in FIG. 1.

Referring first to FIGS. 1 and 2 of the drawings which form a part of the disclosure herein, a railroad freight car 20 has a car body 21 of welded steel which includes a cargo well 22 adapted to be laden by receiving trailers 24. As shown in phantom line in FIG. 1, the wheels 25 of the trailer rest on a floor assembly 26 which helps to define the cargo well 22, and a kingpin portion near the front of each trailer 24 is secured to and supported on a fifth wheel trailer hitch 28 mounted atop a body bolster 30 located at a respective end of the car 20. Alternatively, intermodal cargo containers 32, also shown in phantom line in FIG. 1, may be carried in the cargo well 22, where two of such cargo containers can be stacked one upon another, supported by the floor assembly 26, within the vertical clearance space available along most railroads.

The well 22 has a width 33, defined between a pair of opposite side sills 34, and a length 36, defined between a pair of vertical transverse stiffeners 38. The length and width are great enough to receive a cargo container having a long standard length, such as 48 feet, and a wide standard width such as 102 inches, or to receive a pair of short standard containers each 20 feet long.

A conventional four-wheeled truck 40 located under each body bolster 30 supports the car 20 on a railroad track (not shown), and conventional couplers 42 are provided at the ends of the car 20.

As may be seen in FIGS. 3–8, each of the side sills 34 includes a deep rectangular top chord 44 in the form of a longitudinal channel 45 of bent plate, ¾ inch thick, for example, including a pair of flanges 46, extending horizontally outward. A ¼-inch-thick (for example) web plate 48 of the side sill 34 is welded to the flanges 46 extending vertically between them to close the top chord 44 and extends thence diagonally downwardly and inwardly as a lower panel 50 acting as a web of the side sill 34. A reinforcing angle member 49 welded to the plate 48 extends horizontally between the flanges 46 to reinforce the top chord 44 against buckling without adding an undesirable amount of weight. The lower panels 50, however, are essentially planar between the point of attachment to the respective lower flange 46 and lower margins of the panels 50, and thus carry bending forces from the floor assembly into the top chords 44 of the side sills 34. The side sills 34, thus, are very clean structurally with no additional major reinforcement members.

The well floor assembly 26 is of welded metal construction and is attached to and supported by lower panels 50 of the side sills 34, extending horizontally between them. Opposite end transition portions 52 of the floor assembly 26 are also attached to the lower panels 50 as well as to the vertical transverse stiffeners 38 which define the length 36 of the well 22. The end transition portions 52 carry longitudinal loads from the main portion 54 of the floor assembly 26 to the side sills 34 and to the transverse stiffeners 38 at each end of the car body 21.

Between the well floor end transition portions 52, the main portion 54 of the well floor assembly 26 is an integral rigid welded assembly, including a bottom plate 56 which may be in the form of two opposite side portions each about half the width of the floor assembly 26, extending horizontally for the length of the main portion 54 of the floor assembly 26 and joined together along a longitudinal center joint. The bottom plate 56 may be, for example, 3/16 inch thick.

A longitudinally extending transition channel member 58, of bent plate 7/16 thick, for example, extends along the top of each lateral margin of the bottom plate 56. The transition channel members 58 are specially configured, with a cross-section shape that includes a V-shaped channel portion 60 which has a pair of sides including a diagonally upwardly-and-outwardly directed outer flange portion 62. As may be seen best in FIG. 5, a bottom portion of the V-shaped channel 60 is welded to the lateral margin 64 of the bottom plate 56, while an upper margin of the outer flange portion 62 overlaps and is welded to the inner side of a lower margin 66 of the lower panel 50 of the web sheet 48, so that the floor assembly 26 is suspended from the top chords 44 and extends horizontally between the two side sills 34. Each transition channel member 58 further includes a horizontal transverse portion 68 connected with the other side of the channel 60, and a vertical flange portion 70 extending down from the transverse portion 68 and whose margin is welded to the top side of the bottom plate 56. Thus, the transition channel members 58 resemble a radical, or square root, sign.

The well floor end transition portions 52 each include a pair of transition plates 72 forming the lateral margins of the end transition portions 52. The transition plates 72 are 7/16 inch thick, for example, and extend from each end of the main portion 54 of the floor assembly 56 toward the respective vertical transverse stiffener member 38. Each transition plate 72 is welded to the inwardly extending transverse horizontal lower flange 74 of the respective stiffener 38, as may be seen best in FIG. 3.

A pair of diagonal box beams 76 extend from respective portions of the transition plates 72 adjacent the main portion 54 of the floor assembly 26, converging toward each other, and are welded to a central portion of the horizontal lower flange 74 of the respective transverse stiffener 38. The box beams 76 may be two inches by four inches overall in cross-section size, with a wall thickness of ⅛ inch, for example. A top cover plate 78 is welded to the tops of the beams 76. The top cover plate 78 extends down alongside the outer ends of the box beams 76 and is also welded to the flange 74 to further strengthen the attachment of the outer ends of the beams 76 to the transverse stiffener 38.

Figure 3:
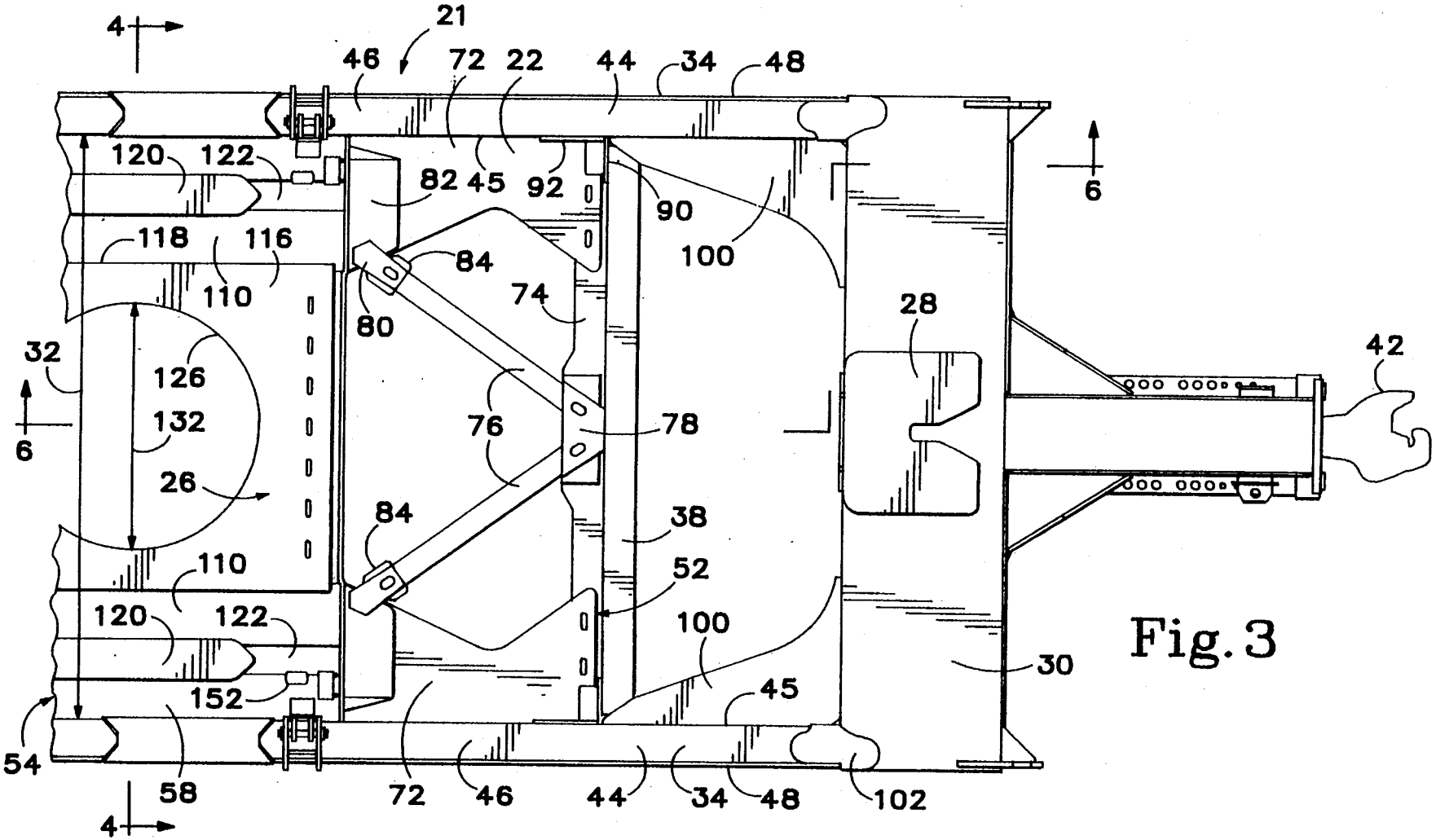
FIG. 3 is a top plan view, at an enlarged scale, of a portion of the car shown in FIGS. 1 and 2.
Figure 4:
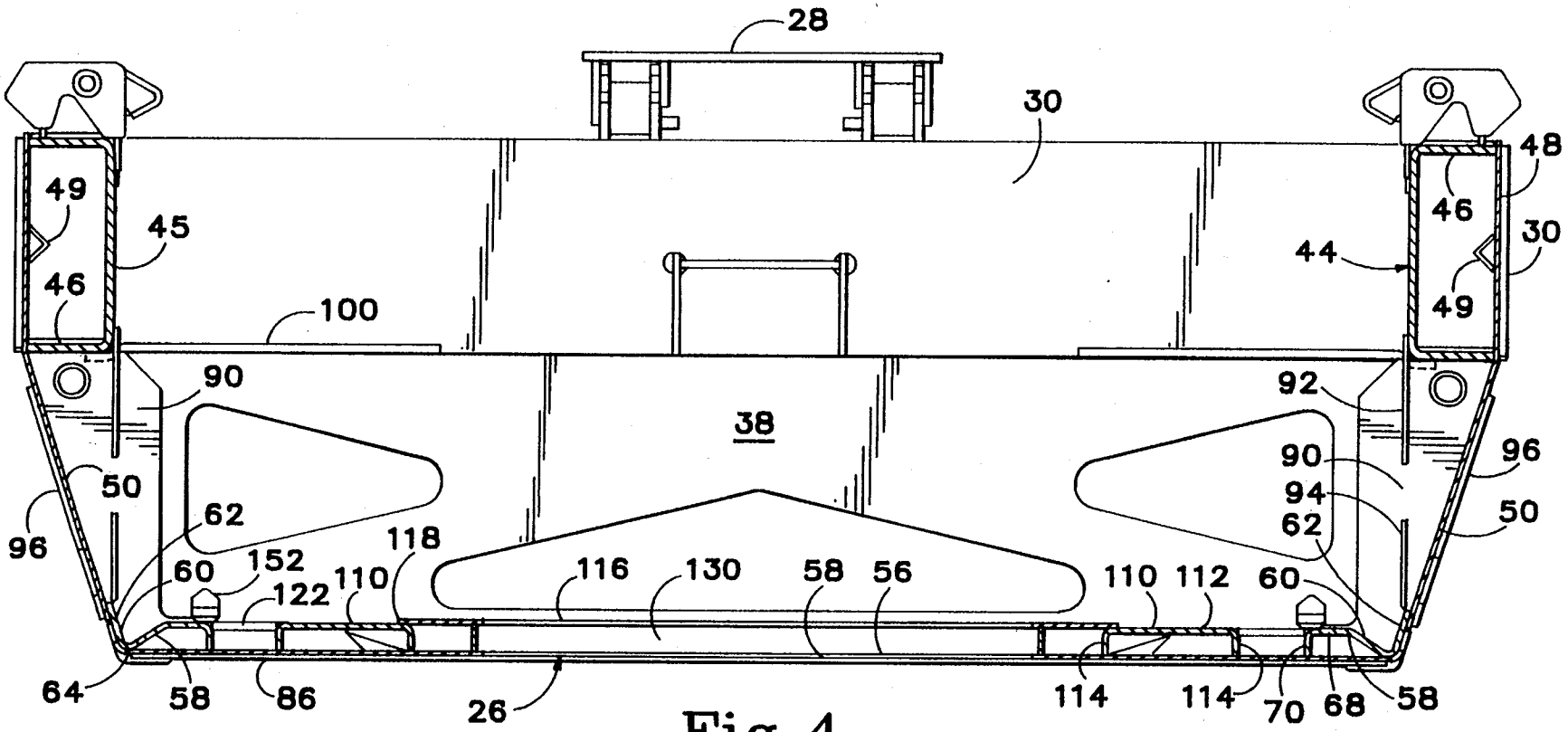
FIG. 4 is a sectional view of the body of the railroad freight car shown in FIGS. 1–3, taken along line 4—4 in FIG. 3, at an enlarged scale.
Figures 5, 6:
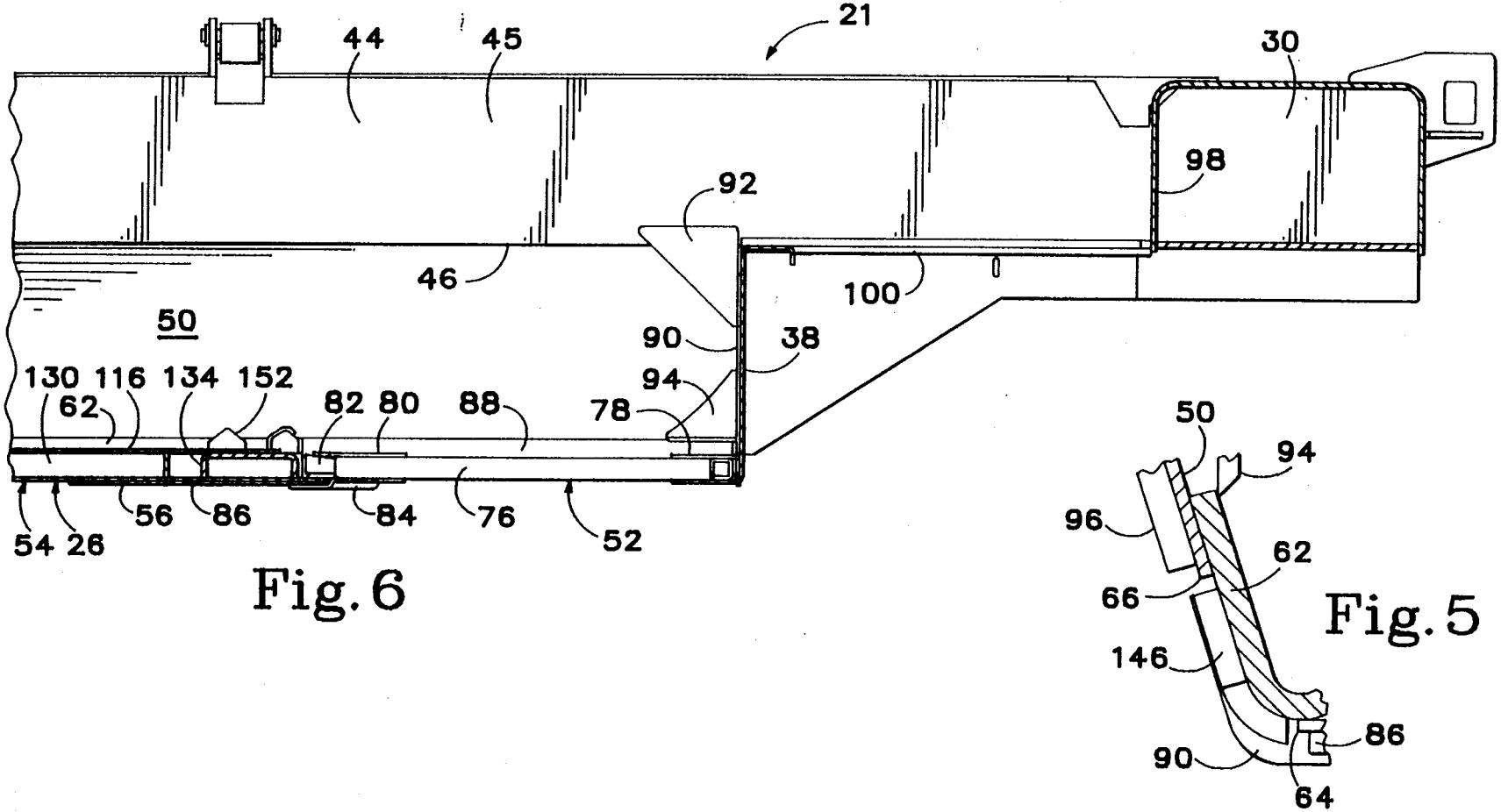
FIG. 5 is an enlarged sectional view of a detail of the portion of a railroad freight car body shown in FIG. 4.
FIG. 6 is a sectional view of a portion of the body of the railroad freight car shown in FIGS. 1–3, taken along line 6—6 of FIG. 3, at an enlarged scale.
Figure 7:
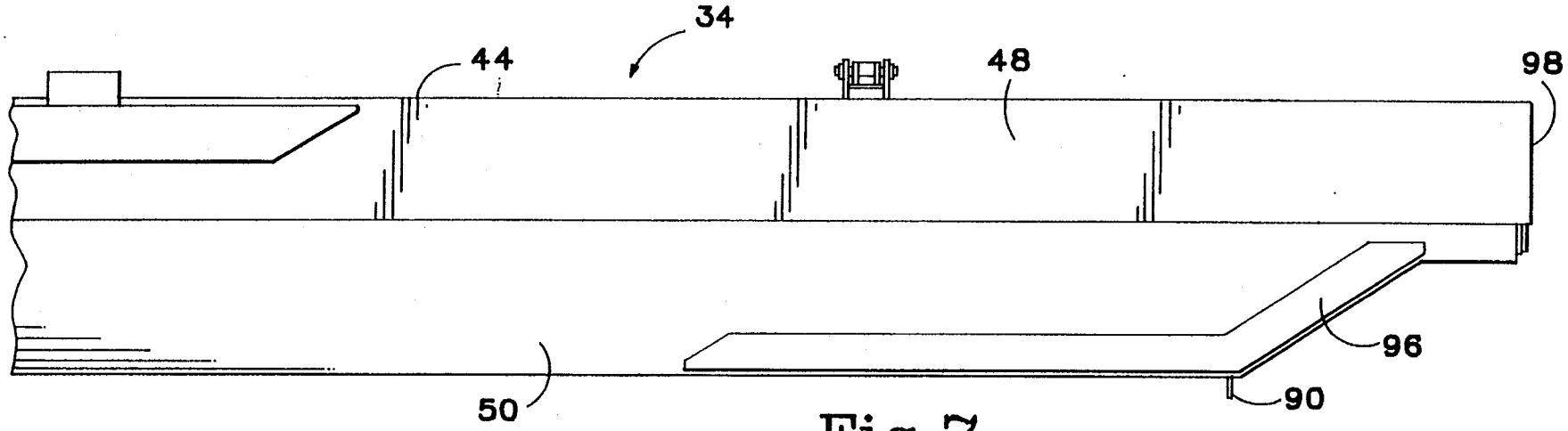
FIG. 7 is a side elevational view of a portion of a side sill of the railroad freight car shown in FIG. 1, at an enlarged scale.
Figure 8:
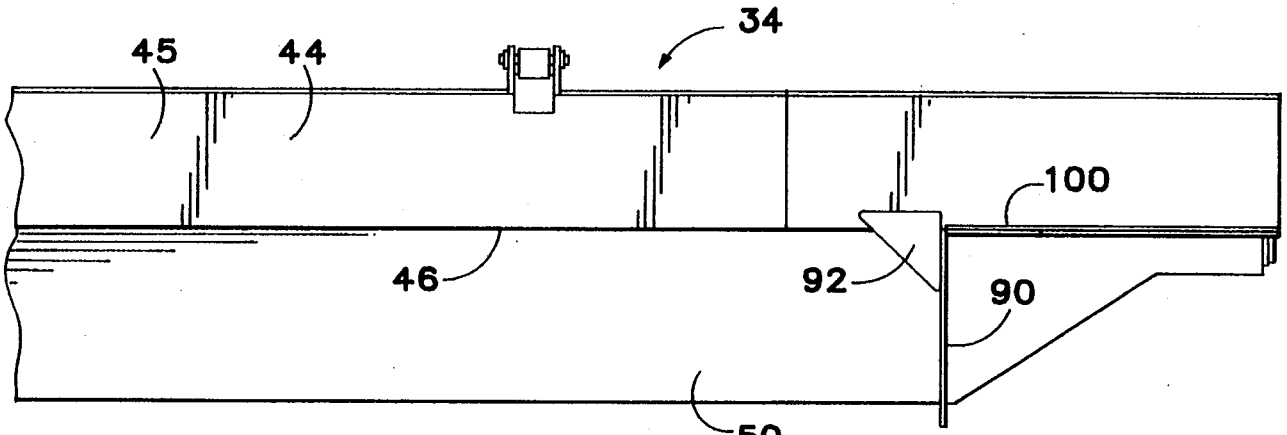
FIG. 8 is a side elevational view, at an enlarged scale, of a portion of a side sill shown in FIG. 1, taken in the direction indicated by the line 6—6 in FIG. 3.

Similarly, as shown also in FIGS. 3 and 6, a top attachment plate 80 is welded to the top of the other, or longitudinally inner, end of each of the beams 76 to attach it to the top of a respective transition ramp member 82 which forms a part of the attachment of the main portion 54 of the floor assembly 26 to the transition plate 72. A bottom attachment plate 84 also cooperates in attachment of the inner ends of the beams 76 to the transition plates 72, through a doubler plate 86 which is attached to the lower faces of the bottom plate 56 and the transition plate 72. The cover plates 78 and attachment plates 80 and 84 may all be 3/16 inch thick, for example.

A diagonally upwardly-and-outwardly extending flange 88 is a portion of each transition plate 72 and is welded to the lower margin 66 of the lower panel 50 of the web sheet 48 to attach the laterally outer margins of the transition plates 72 to the side sills 34.

A stub transverse stiffener 90 (FIGS. 4, 6, and 8) similar in thickness to the transverse stiffeners 38 supports the lower panel 50 of each web sheet 48 beneath the top chord 44 immediately adjacent the transverse stiffener 38, and is welded to the transverse stiffener 38 to interconnect it securely with the side sills 34 and define the end of the cargo well 22. A gusset 92 of similar material interconnects the stub transverse stiffener 90 with the channel 45 of the top chord 44, and a gusset 94 interconnects the upper margin of the outer flange portion 62 of the transition channel member 58 with the stub transverse stiffener 90.

The outer ends 98 of the side sills 34 are welded to each of the body bolsters 30. The body bolsters 30 are transversely-extending box beam structures similar to those used in other railroad well cars of recent design for carrying stacked intermodal cargo containers. The longitudinally outer portions of the lower panel 50 of each side sill 34, the portions extending beyond the transverse stiffeners 38, are diagonally tapered upwardly toward the top chord 44, providing clearance for the truck 40. A doubler plate 96 is provided on the outer side of the lower panel 50 to reinforce the margins of the lower panel 50 on each side of the transverse stiffeners 38.

Large, generally triangular, horizontal gusset plates 100 extend from the top flange of the transverse stiffener 38 to the lower portion of the body bolster 30. The gusset plates 100 carry substantial loads to the body bolster 30, and are therefore of substantial thickness, for example ¾ inch. An outer side margin portion of each gusset 100 extends beneath and is welded to the lower flange 46 of the respective top chord channel member 45, as seen best in FIG. 4. Reinforcing plates 102 strengthen the interconnection of the top flange 46 of the chord 44 of each side sill to the body bolsters, as shown in FIG. 3.

Referring now also to FIGS. 9–17, the longitudinally centrally located main portion 54 of the floor assembly 26 includes a pair of downwardly-open longitudinal channels 110, extending longitudinally of the floor assembly 26, each spaced laterally inward from and parallel with a respective transition channel member 58. Each longitudinal channel 110 may be of bent plate 7/16 inch thick, for example, and has a horizontal web 112 and a pair of vertical flanges 114 of equal size so that the web 112 is parallel with the bottom plate 56. The height of the longitudinal channels 110 is equal to that of the horizontal portion 68 of the longitudinal transition channels 58.

A generally rectangular top plate 116 extends horizontally between the longitudinal channels 110 and has its lateral margins 118 welded respectively to the inboard shoulder of the downwardly open longitudinal channel 110 on each side, so that the top plate 116 of the floor assembly 26 is spaced upwardly apart from the bottom plate 56 by a distance equal to the height of the longitudinal channel 110.

A cover plate 120, 7/16 inch thick, for example, is welded atop the confronting shoulders of each transition channel 58 and the nearby downwardly open longitudinal channel 110 to form an upper surface. The cover plate 120 is additionally supported by heavy doubler plates 122 ⅝ inch thick, for example, located between the confronting vertical flanges 114 and 70 at the positions along the length of the floor assembly 26 where concentrations of weight are to be expected. Doubler plates 122 are thus provided where the ends of a pair of end-to-end cargo containers are to be supported at the mid point of the length 36 of the well 22, and at the ends of the main portion 54 of the floor assembly 26, adjacent the transition plates 72, where the corner posts of the outer ends of containers are to be supported on locator cones. At the locations where the container corner castings are to be located the cover plate 120 is omitted, to provide a small amount of additional clearance.

The transition channel member 58, the cover plate 120, the doubler plate 122, and the longitudinally extending channel 110 all cooperate with the lower panel 50 of the web sheet 48 of the respective side sill 34 to carry loads which would be carried by a lower chord of the side sill 34 if one existed. Additionally, the horizontal transverse portion 68 of the transition channel members 58, the cover plates 120, and the horizontal webs 112 of the longitudinal channels 110 include suitably strong upper surfaces of the floor assembly 26 to support the wheels 25 of trailers 24 carried in the well as shown in FIG. 1.

Figure 10:
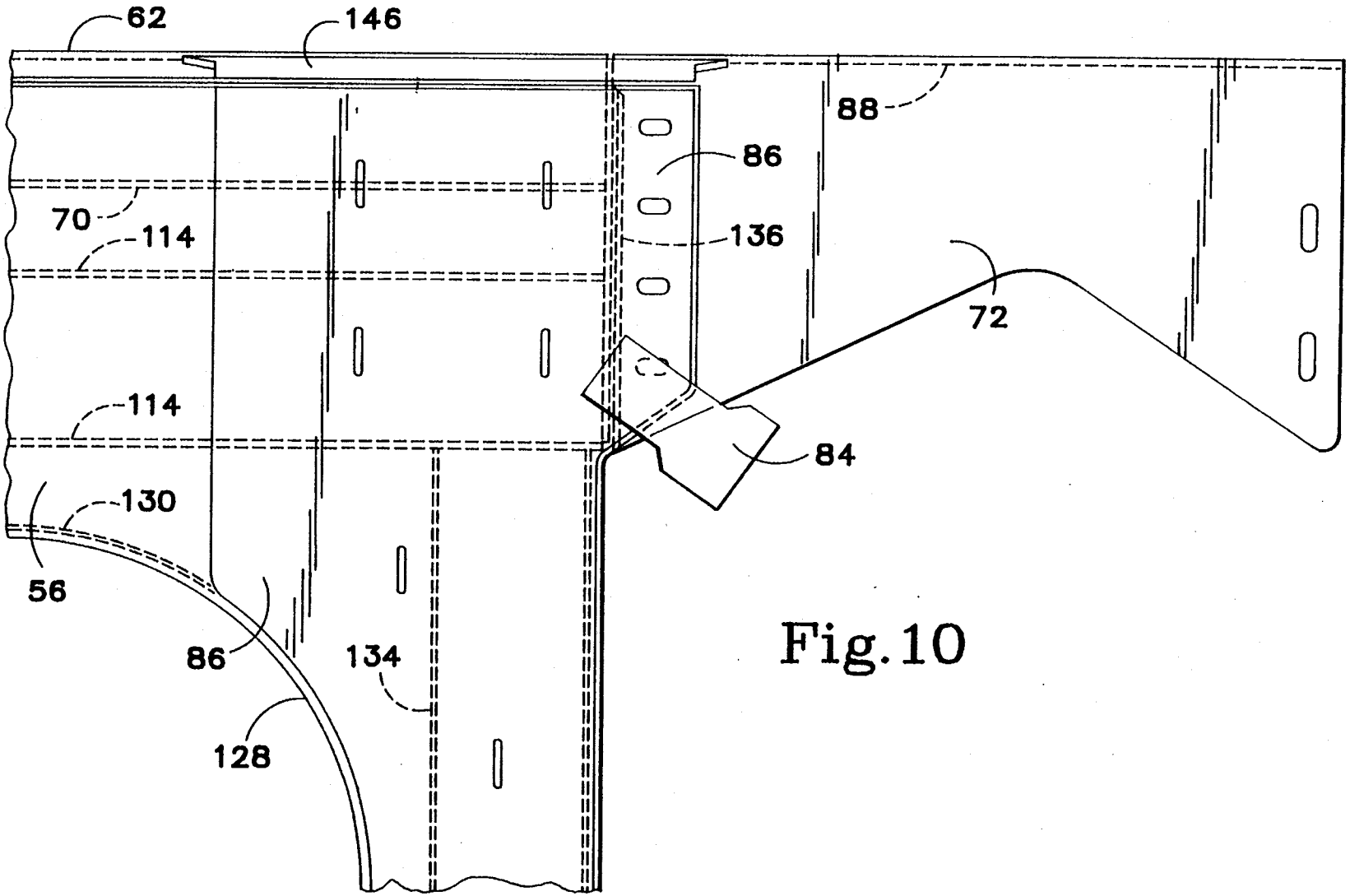
FIG. 10 is a bottom view of part of the portion of a well floor assembly shown in FIG. 10.
Figure 11:
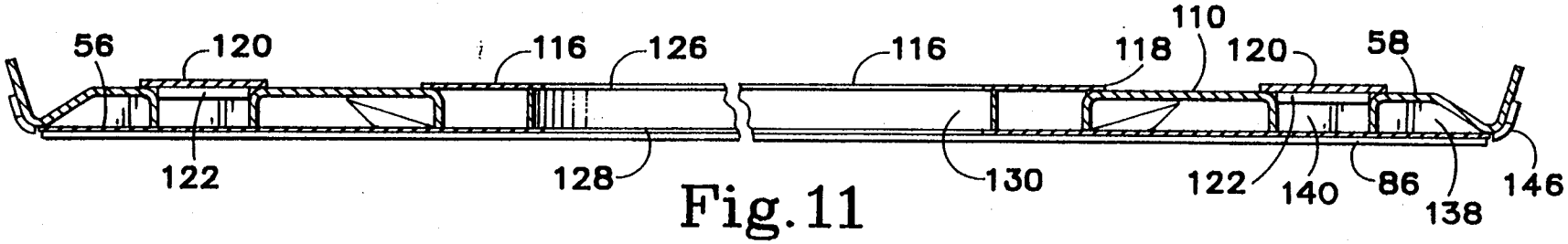
FIG. 11 is a sectional view, at an enlarged scale, of a portion of the well floor assembly shown in FIG. 9, taken along line 11—11.
Figure 12:
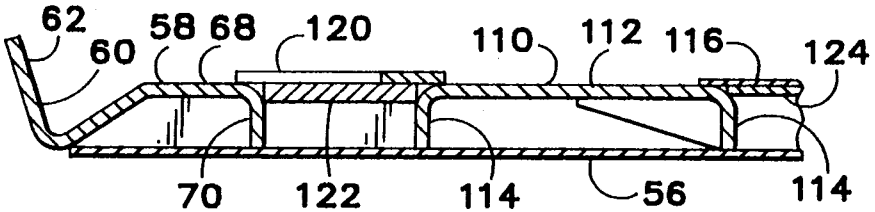
FIG. 12 is a sectional view, at an enlarged scale, of a portion of the well floor assembly shown in FIG. 9, taken along line 12—12.
Figure 13:
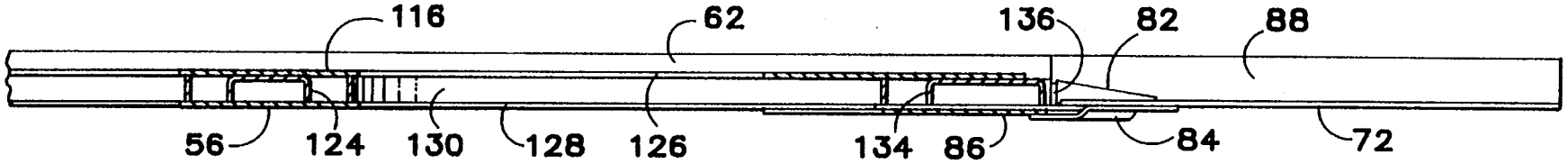
FIG. 13 is a sectional view, at an enlarged scale, of a portion of the well floor assembly shown in FIG. 9, taken along line 13—13.

The floor assembly 26 is further strengthened by several transversely extending beams in the form of downwardly-open channels 124, of bent plate 5/16 inch thick, for example, whose flanges are welded to the bottom plate 56 at locations spaced apart longitudinally along the main portion 54 of the floor assembly 26. The top plate 116 is welded to the web of each transverse channel 124 through conventional openings provided for that purpose. A similar but wider transversely extending end channel 134 is located at each end of the main portion 54 of the floor assembly, as shown in FIGS. 6 and 10.

In order to provide additional stiffness while also reducing the weight of the bottom assembly 26, the bottom plate 56 and the top plate 116 each respectively define several large openings 126 and 128, preferably circular in shape, of equal size, and located directly above one another. A stiffener 130 extends vertically between the bottom plate 56 and top plate 116 and surrounds the large openings 126 and 128. The stiffener 130 is of metal plate material ¼ inch thick, for example, forming a circular wall enclosing the large openings 126 and 128. The stiffener 130 is welded to both the bottom plate 56 and top plate 116 about the entire periphery of the large openings 126 and 128, interconnecting the top plate 116 and the bottom plate 56 as a stiff structure. The height of the longitudinal channels 110, establishing the distance separating the bottom plate 56 from the top plate 116, may be 2-9/32 inch, for example, and the stiffener 130 correspondingly would have a height of 2-¼ inches.

In a car 20 in which the length 36 of the well 22 is slightly greater than 48 feet, in order to receive a nominally 48-foot-long cargo container, preferably eight sets of corresponding vertically aligned large openings 126, 128 are provided, each having a diameter 132 of 44 inches, with the circular stiffeners 130 having an inside diameter of 45 inches, providing an overhang of about ½ inch of the margins of the top plate 116 and bottom plate 56 inside the stiffeners 130 to allow for convenient welding and stress relief.

As shown also in FIGS. 9, 10, 12 and 13, the transverse channel members 124 are located between the adjacent pairs of large openings and the similar, but wider, transverse end channels 134 are located between the top plate 116 and bottom plate 56 at each end of the main portion 54 of the floor assembly 26, adjacent the well floor end transition portions 52.

In order to provide adequate strength for transfer of loads from the main portion 54 of the well floor assembly 26 to the end transition portion 52 at each end, and ultimately to the body bolster 30, a respective doubler plate 86 is welded to the underside of the bottom plate 56 adjacent each end of the main portion 54, extending about two feet toward the center of the length of the car body 21. A portion of the doubler plate 86 extends longitudinally outward beyond the wide transverse end channel member 134 at each end of the main body portion 54 and is welded to the bottom side of the respective transition plate 72 at each side of the floor assembly 26. The respective bottom attachment plate 84 for each diagonal box beam 76 is bent to fit closely along the bottom side of the doubler plate 86 and extends thence along the bottom side of the transition plate 72.

An end cap 136 extends vertically and transversely across the ends of the transition channel member 58 and the downwardly open longitudinal channel 110 on each side at each end of the main portion 54. Each transition ramp 82 is welded to the respective end cap 136 and extends slopingly from it to the top surface of the transition plate 72.

Figure 9:
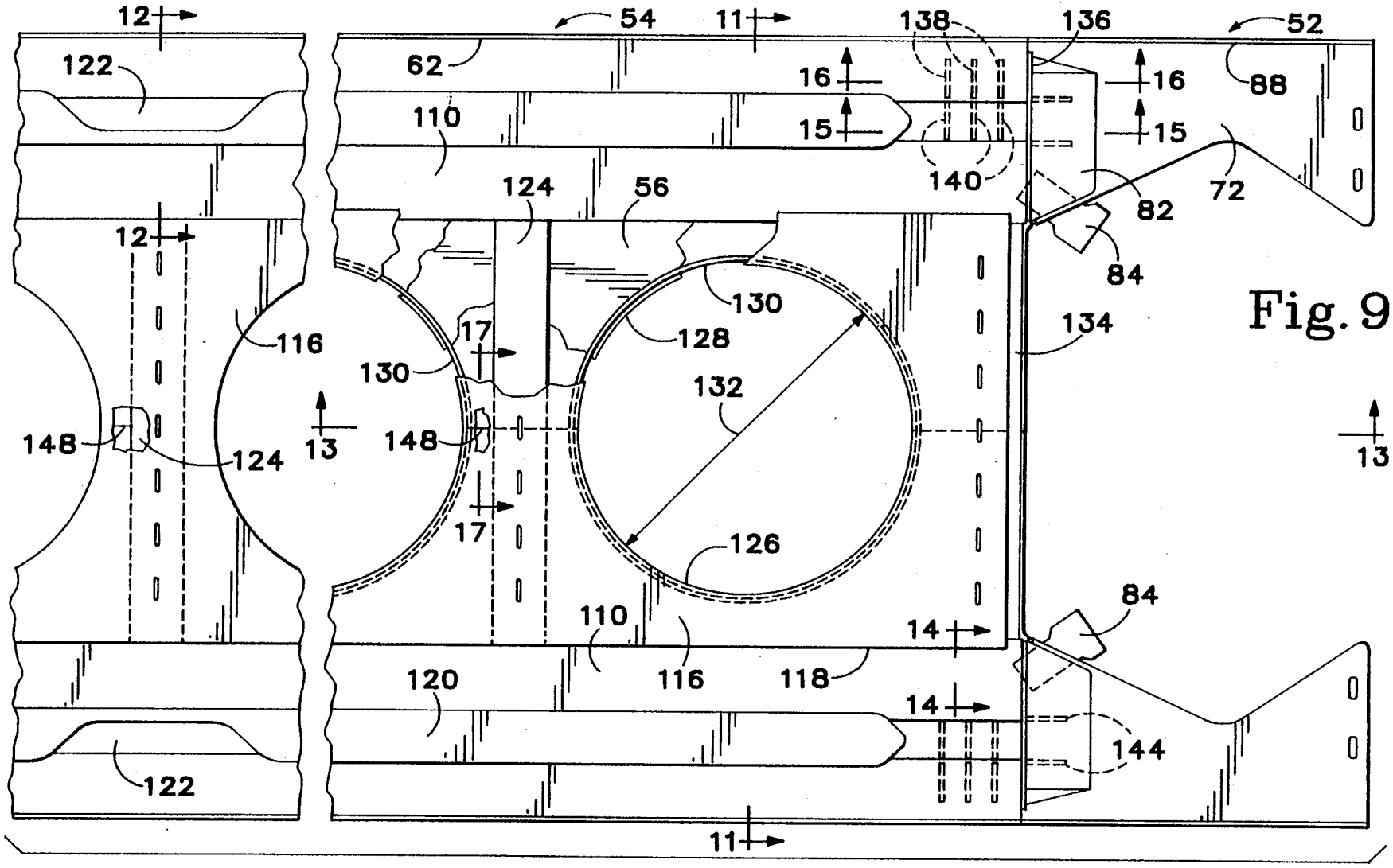
FIG. 9 is partially cut-away, top plan view, at an enlarged scale, of a portion of the well floor assembly of the railroad freight car shown in FIGS. 1–3.
Figure 15:
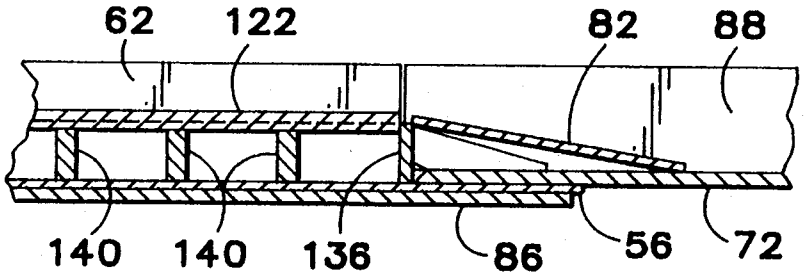
FIG. 15 is a sectional view, at an enlarged scale, of a portion of the well floor assembly shown in FIG. 9, taken along line 15—15.
Figure 14:
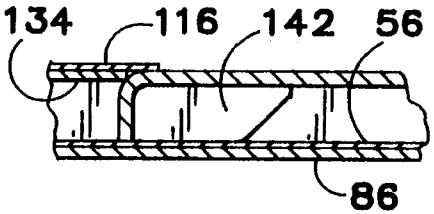
FIG. 14 is a sectional view, at an enlarged scale, of a portion of the well floor assembly shown in FIG. 9, taken along line 14—14.
Figure 16:
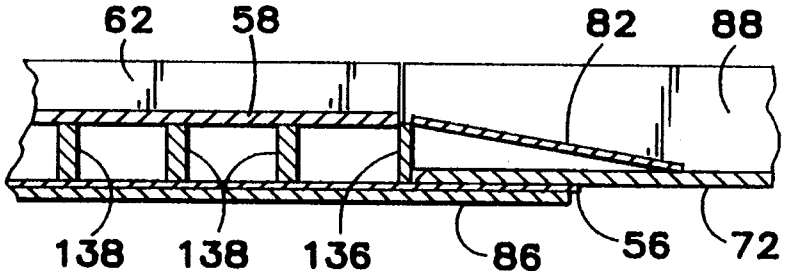
FIG. 16 is a sectional view, at an enlarged scale, of a portion of the well floor assembly shown in FIG. 9, taken along line 16—16.

Groups of transverse reinforcing pieces 138 and 140 extend vertically between the bottom plate 56 and the underside of the transition channel member 58 and the doubler plate 86, respectively, near each corner of the main portion 54 of the floor assembly 26, as shown in FIGS. 9, 15, and 16. A transition plate 142, shown in FIGS. 9 and 14, provides additional support for the longitudinal channel member 110 at each end of the main portion 54, extending vertically and laterally adjacent the end cap 136.

A "J"-shaped doubler 146 is located on the outer side of the floor assembly 26, below a part of the horizontal portion of each doubler plate 96 near the lower margin of each side sill 34. The J-shaped doublers 146 extend longitudinally over a distance extending slightly beyond the doubler plate 86, and thus reinforce a portion of the outer flange 88 of each transition plate 72 and a portion of the outer flange 62 at each end of each transition channel member 58. The outer diagonal flange 88 of each transition plate 72 also aids in the transmission of forces from the main portion 54 of the floor assembly 26 to the end transition portions 52.

Figure 17:
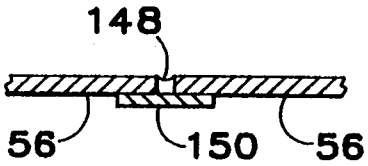
FIG. 17 is a sectional view, at an enlarged scale, of a portion of the well floor assembly shown in FIG. 9, taken along the line 17—17.

As shown in FIG. 17, except at the mid-length location along the floor assembly 26 the two longitudinally-extending halves of the bottom plate 56 are joined by a weld 148 and reinforcing a cover strip 150 extending longitudinally of the floor assembly 26 on the bottom side, at the ends of the main portion 54 and between the large openings 126 at places other than the mid-length location. However, at the mid-length position the cover strip 150 is preferably not used where track clearance height beneath the car is most critical.

Standard cargo container locator cones 152 are supported upon the reinforced portions of the corners of the main portion 54 of the well floor assembly 26, where the doubler plates 122 are not covered by the cover plates 120. At the mid-length portion of the car, between the middle pair of large openings 126, 128, the doubler plates 122 are also partially exposed as a landing spot for the corner posts of each of a pair of short containers carried end-to-end within the cargo well 22 as shown in FIG. 1.

Referring now to FIGS. 18–27, one end of a railroad freight car 160, similar in most respects to the freight car 20, is shown. Except as to those elements which differ from corresponding elements of the freight car 20 previously described, the reference numerals used in FIGS. 1–17 will be used in FIGS. 18–27 to refer to like parts of the car 160.

Extending atop each side sill 34 of the body 21' of the car 160 is a respective side sill reinforcing structure 162 mounted atop the top chord 44 of the side sill 34. The side sill reinforcing structure 162 has a length 164, and extends longitudinally of the car and along side a portion of the cargo well 22, from a location adjacent the outer end 98 of the side sill 34, where it is connected with the body bolster 30. An end 166 of the side sill reinforcing structure 162 is aligned with the cargo container locator cone 152, which is located at the position longitudinally of the cargo well 22 where inter box connectors (IBCs) are located to interconnect upper-tier and lower-tier containers 32 to each other in the cargo well 22. A trailer 24 is located in the cargo well 22, and a loading crane leg 168 is shown extending downward alongside the trailer 24, with its trailer-engaging foot 170 engaged with the bottom longitudinal frame rail of the trailer 24. The portion of the foot 170 which extends downward lower than the bottom of the trailer 24 has a thickness 172.

Figure 19:
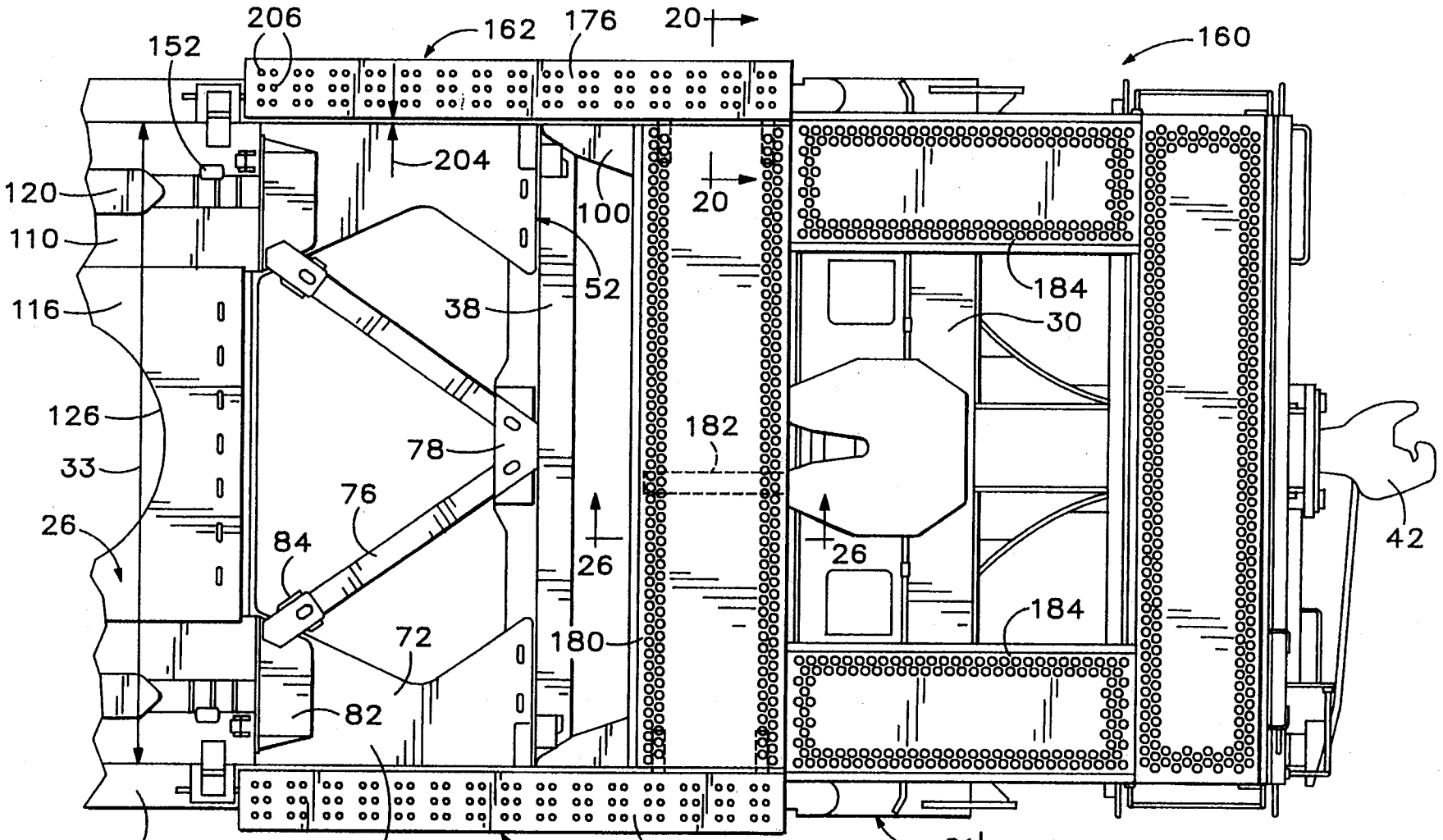
FIG. 19 is a top plan view of the body of the portion of a railroad freight car shown in FIG. 18.
Figure 26:
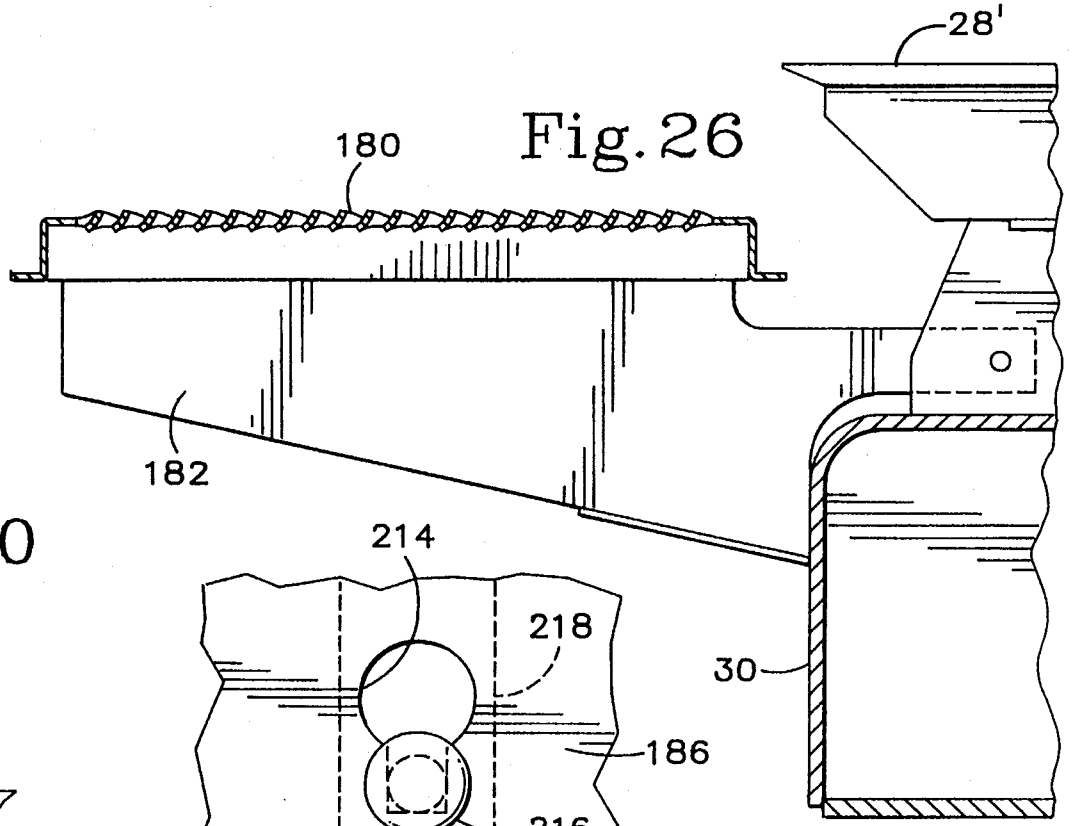
FIG. 26 is a sectional view, taken along line 26—26 of FIG. 19.
Figure 27:
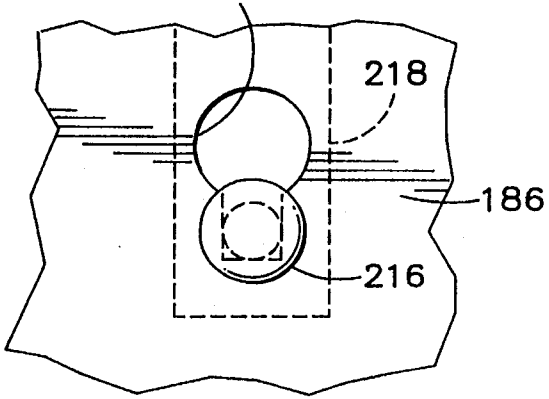
FIG. 27 is a detail view, at an enlarged scale, of the reinforcing walkway structure according to the present invention, taken along line 27—27 of FIG. 20.

A trailer hitch 28' is mounted atop the body bolster 30 and is oriented, as shown best in FIG. 19, so as to receive the king pin (not shown) of the trailer 24 as it moves into engagement with the trailer hitch 28' from the direction of the center of the car 160. In other respects, the trailer hitch 28' is similar to the trailer hitch 28 shown in FIGS. 1 and 2. The top surface of the trailer hitch 28', on which the bottom of the trailer 24 rests, has a height 174, of several inches above the top of the top chord 44, for example, as much as 12-½ inches.

Figure 18:
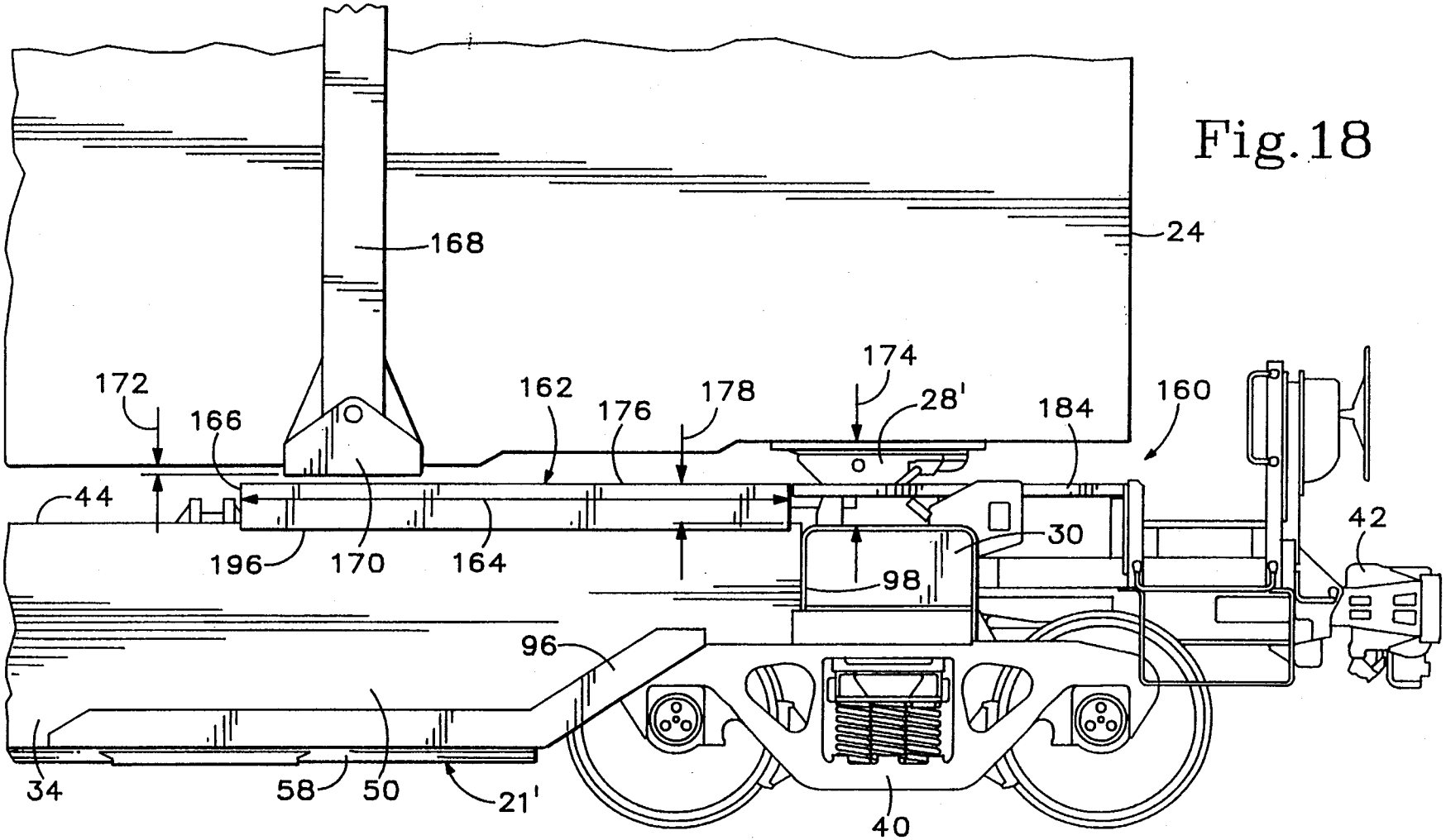
FIG. 18 is a side elevational view of a portion of a railroad freight car which is an alternative embodiment of the present invention, together with portions of a trailer and a loading crane engaging a lift point along a lower longitudinal frame member of the trailer.

The reinforcing structure 162 has a horizontal top 176, located above the top of the top chord 44 at a height 178, which is less than the height 174. The height 178 is smaller than the height 174 by a distance great enough to leave, at a minimum, sufficient clearance for the thickness 172 of the foot 170 of the loading crane leg 168. The difference between the height 178 and the height 174 may preferably be greater, as shown in FIG. 18, in order to accommodate a trailer 24 in which the bottom longitudinal frame rail may be located lower than the turntable surface on the bottom of the trailer. At the same time, however, the height 178 is great enough so that a person standing atop the horizontal top 176 of the reinforcing structure 162 will be able to reach an IBC used to attach an upper-tier container 32 to a lower-tier container 32.

A transverse horizontal walkway 180 extends between opposite reinforcing structures 162 and is supported, in part, by attachment to the reinforcing structure 162 on each side of the car 160. A support 182 is mounted on the body bolster 30 and supports a central portion of the transverse walkway 180. A respective one of a pair of longitudinal walkways 184 extends toward the end of the car 162 from the transverse walkway 180, on each side of the car 160, as may be seen in FIG. 19.

Figure 20:
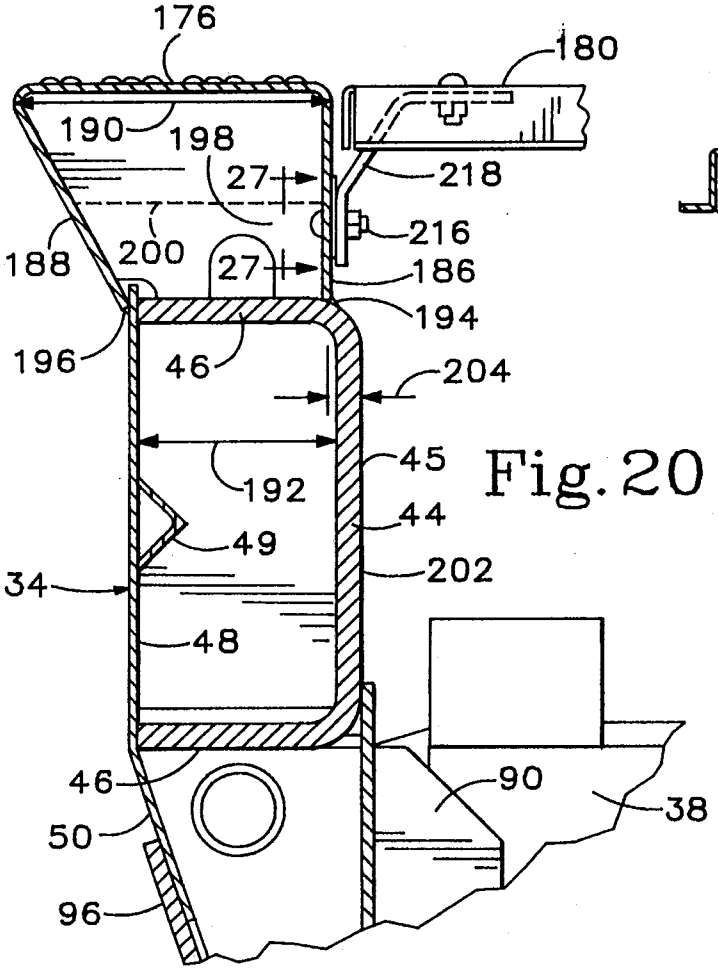
FIG. 20 is a sectional view, taken along line 20—20 of FIG. 19, showing a portion of a side sill and an associated reinforcing walkway structure which is part of the railroad freight car shown in FIGS. 18 and 19.
Figure 21:
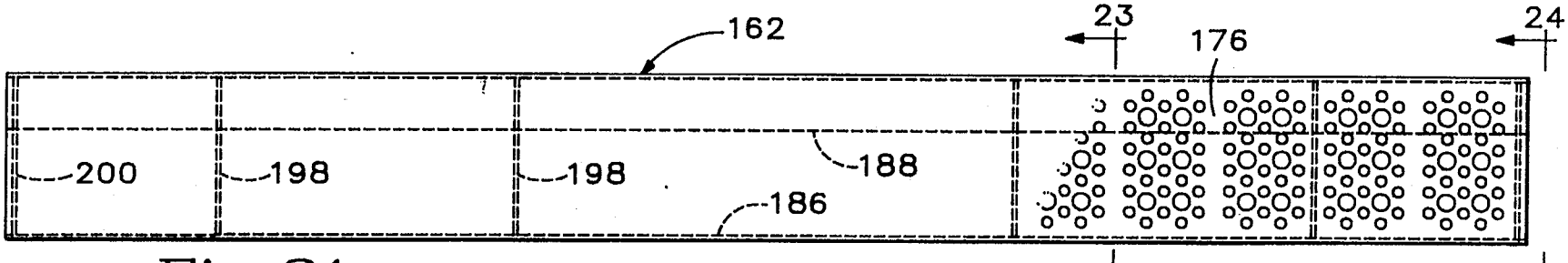
FIG. 21 is a top plan view, at an enlarged scale, of the reinforcing walkway structure shown in FIGS. 18–20, at an enlarged scale.

Preferably, as may be seen in FIG. 20, the reinforcing structure 162 includes a main member in the form of a channel having the shape of an inverted U, with the horizontal top 176 forming the base of the U. The legs of the U are an inner leg 186 extending longitudinally of the car 160 and oriented vertically, and an outer leg 188 which extends diagonally downwardly and inwardly toward the top chord 44 of the side sill 34. The width 190 of the horizontal top 176 is thus greater than the width 192 of the top chord 44, so that the horizontal top 176 of the reinforcing structure provides a greater area than that of the top of the top chord 44, for a person to stand upon while operating IBCs. Because the reinforcing structures 162 are close to the ends of the car 160, there is sufficient room for such laterally outward protrusion of the reinforcing structure 162, despite the need for the longitudinally central portions of the side sills to be spaced closer together in order for the car 160 to negotiate curves safely.

The channel member of the reinforcing structure 162 is preferably manufactured of steel plate, for example ¼ inch thick, bent to the required shape. The channel is reinforced by three intermediate stiffener plates 198 and a pair of end stiffener plates 200, each welded to the channel at the appropriate location. The lower margins of the inner leg 186 and outer leg 188 of the reinforcing structure 162 are welded to the top chord 44, preferably along substantially their entire length, as shown at 194 and 196, respectively. The reinforcing structure 162 is welded atop the top chord 44 with the inner leg 186 spaced outwardly from the inner face 202 of the top chord 44 by a distance 204 of, for example, 1.25 inches, in order to reduce somewhat the likelihood of the reinforcing structure 162 being struck by a container 32 or trailer 24 being moved into or out of the cargo well 32. At the same time, however, the reinforcing structure 162 is strong enough to withstand the weight of a container 32 or trailer 24, should it be lowered accidentally onto the horizontal top 176, and is substantial enough to strengthen the side sill 34 where its lower margin slopes upward to provide clearance for the truck 40.

Figure 25:
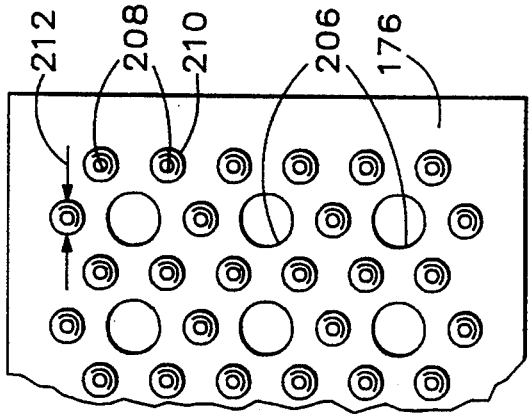
FIG. 25 is a top plan view of a detail of the reinforcing walkway structure shown in FIGS. 18–24, at a further enlarged scale.
Figure 24:
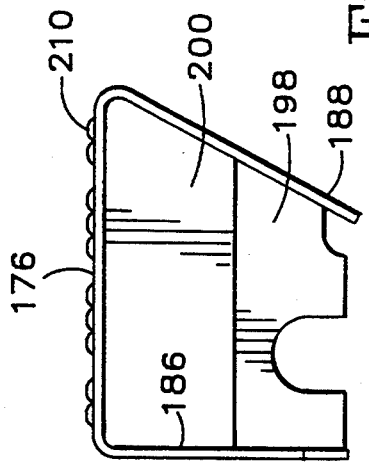
FIG. 24 is a sectional view of the reinforcing walkway structure shown in FIGS. 18–22, taken along line 24—24 of FIG. 21, at a further enlarged scale.
Figure 23:
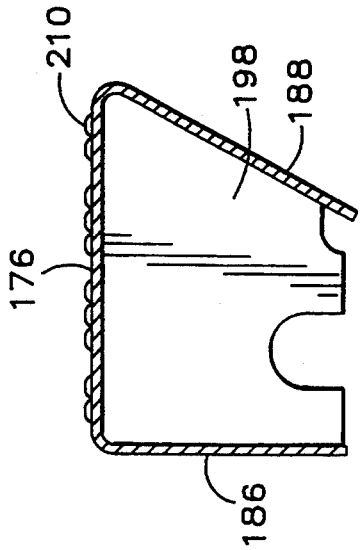
FIG. 23 is a sectional view of the reinforcing walkway structure shown in FIGS. 18–22, taken along line 23—23 of FIG. 21, at a further enlarged scale.

The horizontal top 176 is perforated, defining a pattern of large, generally circular holes 206 each having a diameter of, for example, about 1 inch, surrounded by a pattern of smaller holes 208, each having a diameter of, for example, ¼ inch. Each of the smaller holes 208 is surrounded by a raised annular rim 210, the holes 208 and rims 210 together forming a raised perforated dimple having a diameter 212 of, for example, ⅝ inch. The arrangement of holes 206 and surrounding perforated dimples, as shown in FIG. 25, provides ample space for rain or slush to fall downward through the horizontal top 176, clearing the horizontal top 176 sufficiently that it provides a reliable non-skid walkway surface.

Alternatively, another type of non-skid surface (not shown), such as use of non-skid paint or other surface covering, or a non-skid surface configuration of raised ridges in a basket-weave pattern, commonly known as "diamond tread," might be used atop the horizontal top 176.

The pattern of holes 206 and 208, on the other hand, leaves most of the metal of which the horizontal top 176 is made. Ample strength, then, is still provided by the reinforcing structure 162, both to carry some of the structural loads in that portion of the side sills 34 and to resist damage from inadvertently being struck by containers 32, trailers 24, or equipment used to handle them.

Figure 22:
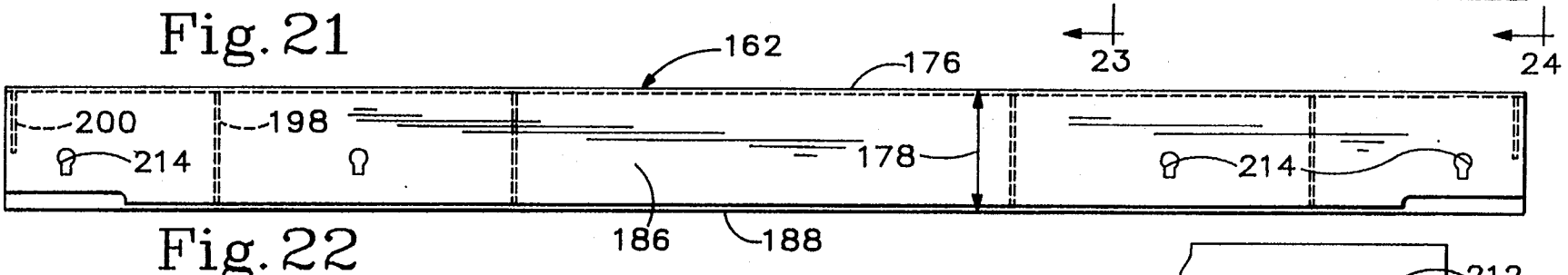
FIG. 22 is a side elevational view of the reinforcing walkway shown in FIG. 21, taken from within the cargo well of the car shown in FIGS. 18 and 19.

As may be seen more particularly in FIG. 22, the reinforcing structures 162 are symmetrical, and include a pair of keyhole-shaped openings 214 near each end of the inner leg 186 to receive a fastener such as a bolt 216 attaching a bracket 218 to support the transverse walkway 180. The transverse walkway 180 may be of a conventional construction of expanded metal providing ample strength to support a worker, but, since it is not intended to add significantly to the structural strength of the car body, the transverse walkway 180 need not be of such substantial material as the reinforcing structure 162.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A railroad freight car, comprising:

(a) a car body having a pair of opposite ends and defining a cargo well having a length and a width;

(b) a pair of longitudinally extending opposite side sills defining said width of said well, each said side sill including a top chord; and (c) a longitudinally-extending side sill reinforcing structure mounted atop said top chord and extending along a portion thereof alongside a portion of said cargo well adjacent one of said opposite ends of said car body, said reinforcing structure including a horizontal top having a walkway surface associated therewith, said side sill reinforcing structure having a length and including a channel structure in the form of an inverted U including said horizontal top and a pair of downwardly extending opposite legs, each of said legs extending longitudinally along said top chord and being welded thereto along a majority of said length of said reinforcing structure.

2. The railroad freight car of claim 1 wherein said side sill reinforcing structure includes a plurality of transverse vertical stiffeners spaced longitudinally apart from one another, each stiffener interconnecting said opposite legs of said channel structure at a respective position along said length of said reinforcing structure.

3. The railroad freight car of claim 1 wherein said top chord has an inner face and an inner one of said opposite legs of said channel structure is located in a longitudinal vertical plane located a predetermined distance outward from said inner face of said top chord.

4. The railroad freight car of claim 3 wherein said top chord has a first width and said side sill reinforcing structure has a second width greater than said first width, and wherein an outer one of said opposite legs of said channel structure extends diagonally downward and inward from said horizontal top to said top chord of said side sill.

* * * * *